US009169049B2

(12) United States Patent
Mayo et al.

(10) Patent No.: US 9,169,049 B2
(45) Date of Patent: Oct. 27, 2015

(54) DEVICES SUITABLE FOR REMOVING, PREPARING, AND STORING MATERIALS

(75) Inventors: Diana Lynn Mayo, Edwardsville, IL (US); Stephen Andrew Wurth, St. Louis, MO (US); Gary W. Etheridge, St. Louis, MO (US)

(73) Assignee: Nestec S.A., Vevey (CH)

( * ) Notice: Subject to any disclaimer, the term of this patent is extended or adjusted under 35 U.S.C. 154(b) by 1783 days.

(21) Appl. No.: 11/714,525

(22) Filed: Mar. 6, 2007

(65) Prior Publication Data

US 2008/0217333 A1 Sep. 11, 2008

(51) Int. Cl.

| | |
|---|---|
| ***B65D 51/24*** | (2006.01) |
| ***B65D 51/32*** | (2006.01) |
| ***A47G 19/18*** | (2006.01) |

(52) U.S. Cl.

CPC ..... *B65D 51/32* (2013.01); *A47G 19/186* (2013.01)

(58) Field of Classification Search

CPC ..... B65D 51/24; B65D 51/246; B65D 51/32; A47G 19/186

USPC ..... 220/212, 212.5, 695, 696, DIG. 10

See application file for complete search history.

(56) References Cited

U.S. PATENT DOCUMENTS

| | | | | | |
|---|---|---|---|---|---|
| 1,398,366 | A | * | 11/1921 | De Olaneta | 429/82 |
| 1,834,085 | A | * | 12/1931 | Bloom | 229/125.03 |
| 2,106,313 | A | * | 1/1938 | Amrine | 401/128 |
| 2,939,216 | A | * | 6/1960 | Armstrong | 30/324 |
| 4,215,471 | A | * | 8/1980 | Schaefer | 30/147 |
| 4,984,367 | A | * | 1/1991 | Albanese | 30/147 |
| 5,251,774 | A | | 10/1993 | Engle | |
| 6,578,725 | B2 | * | 6/2003 | Delman et al. | 220/212 |
| 2006/0144340 | A1 | | 7/2006 | Burge et al. | |

FOREIGN PATENT DOCUMENTS

WO WO2006/102710 A1 10/2006

OTHER PUBLICATIONS http://www.ourpets.com/products_hc.html Copyright 2005 OurPet's Company (2 pages).

* cited by examiner

*Primary Examiner* — Fenn Mathew
*Assistant Examiner* — Andrew T Kirsch
(74) *Attorney, Agent, or Firm* — Julie M. Lappin

(57) ABSTRACT

Devices suitable for removing materials from a container, preparing the materials for further use, and storing unused materials in the container for future use are provided. Generally, the devices comprise an elongated portion defining (1) a handle and a blade and (2) an over-cap attached to the elongated portion. The over-cap can define an aperture that surrounds a portion of the handle.

12 Claims, 3 Drawing Sheets

DEVICES SUITABLE FOR REMOVING, PREPARING, AND STORING MATERIALS

BACKGROUND OF THE INVENTION

1. Field of the Invention

The present invention relates generally to devices useful for handling materials and particularly to devices suitable for removing materials from containers, preparing the materials for further use, and storing any remaining materials in the container.

2. Description of the Related Art

Most materials are available in standard size containers. Often the user needs to remove all or a portion of the materials from the container for use. However, removing the materials is often difficult. The materials may spill or may be of a consistency that makes it difficult to remove all of the materials from the container. Similarly, the materials may get on the user's hands while the materials are being removed from the container.

Further, the user may need to remove only a portion of the materials. However, the entire contents of the container may come out of the container even though only a portion is desired. After a portion of the materials have been removed, the removed materials may have to be prepared for further use. Preparing such materials may be difficult if there is not a practical and convenient way to prepare the materials, e.g., stir the materials, mix the materials with other materials, place the materials in other containers, and the like.

After a portion of the materials have been removed, the remaining materials may have to be discarded or stored for future use. Storage may be difficult if there is not a practical and convenient way to reseal the container and protect the contents from the environment. This is particularly true for material containers with disposable lids that are discarded after opening, e.g., pop-top lids used on many food containers.

There is, therefore, a need for novel devices suitable for removing materials from containers, preparing the materials for further use, and storing any remaining materials in the container for future use.

SUMMARY OF THE INVENTION

It is, therefore, an object of the present invention to provide devices suitable for removing materials from containers.

It is another object of the present invention to provide devices suitable for preparing materials for further use.

It is a further object of the present to provide devices suitable for storing materials in the container for future use.

It is another object of the present invention to provide articles of manufacture in the form of kits that contain combinations of the devices of the present invention and food compositions, and other devices, particularly combinations useful for removing materials from containers, preparing the materials for further use, and storing any remaining materials in the container.

One or more of these other objects are achieved using novel devices suitable for removing materials from containers, preparing the materials for further use, and/or storing any remaining materials in the container for future use. Generally, the devices comprise an elongated portion defining (1) a handle and a blade and (2) an over-cap attached to the elongated portion. The handle is useful for providing the user with a means for gripping the device, the blade is useful for removing materials from a container and/or preparing materials removed from a container, and the over-cap is useful for sealing an opened container and storing materials remaining in the container after it is opened.

Other and further objects, features, and advantages of the present invention will be readily apparent to those skilled in the art.

DETAILED DESCRIPTION OF THE INVENTION

Definitions

Figure 1:
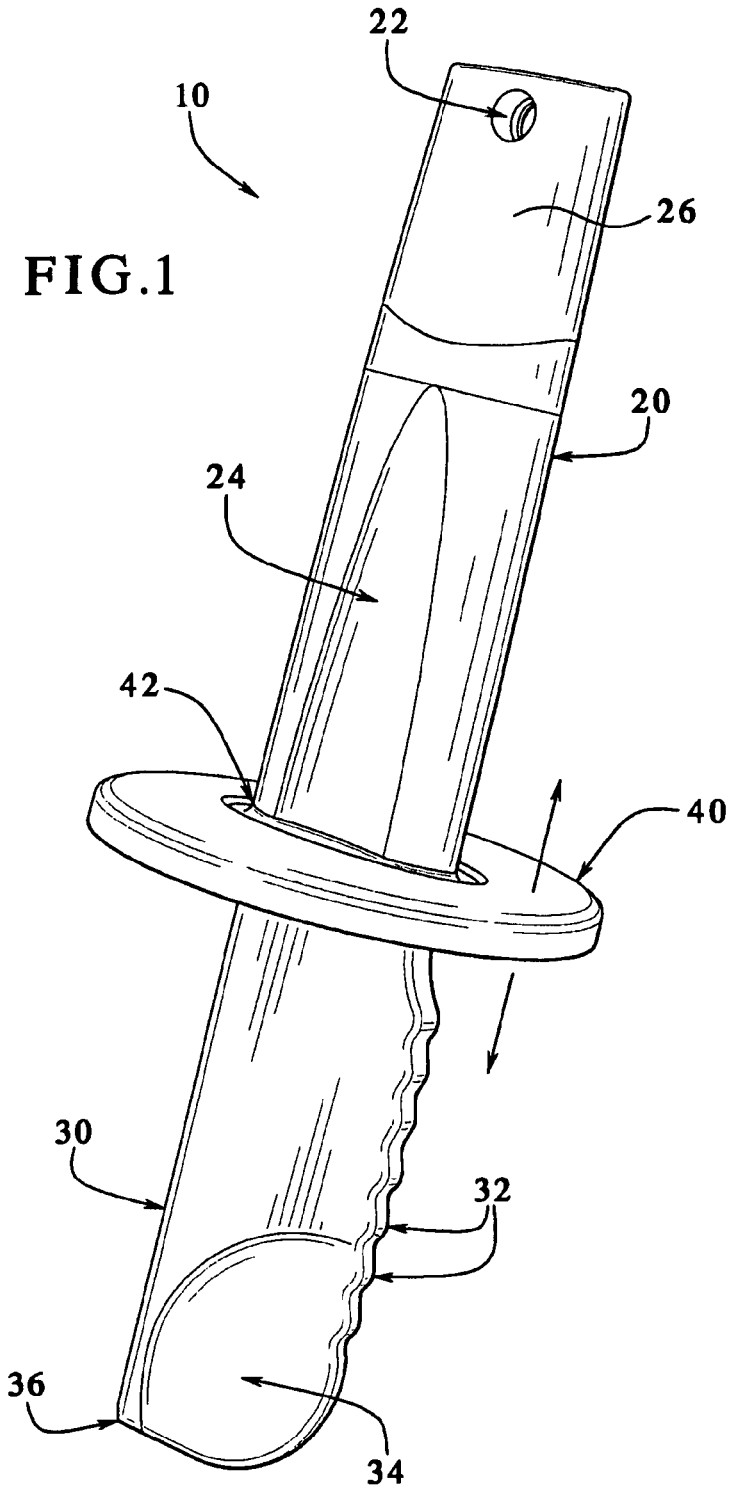
FIG. 1 illustrates a front perspective view of an embodiment of the device of the present invention.

The term "single package" means that the components of a kit are physically associated in or with one or more containers and considered a unit for manufacture, distribution, sale, or use. Containers include, but are not limited to, bags, boxes, bottles, shrink wrap packages, stapled or otherwise affixed components, or combinations thereof. A single package may be containers of individual food compositions physically associated such that they are considered a unit for manufacture, distribution, sale, or use.

The term "virtual package" means that the components of a kit are associated by directions on one or more physical or virtual kit components instructing the user how to obtain the other components, e.g., in a bag containing one component and directions instructing the user to go to a website, contact a recorded message, view a visual message, or contact a caregiver or instructor to obtain instructions on how to use the kit.

The terminology used herein is for the purpose of describing particular embodiments only and is not intended to limit the scope of the present invention. As used herein and in the appended claims, the singular forms "a," "an," and "the" include plural reference unless the context clearly dictates otherwise. Similarly, the words "comprise", "comprises", and "comprising" are to be interpreted inclusively rather than exclusively.

Unless defined otherwise, all technical and scientific terms and any acronyms used herein have the same meanings as commonly understood by one of ordinary skill in the art in the field of the invention. Although any compositions, methods, articles of manufacture, or other means or materials similar or equivalent to those described herein can be used in the practice of the present invention, the preferred compositions, methods, articles of manufacture, or other means or materials are described herein.

All patents, patent applications, publications, and other references cited or referred to herein are incorporated herein by reference to the extent allowed by law. The discussion of those references is intended merely to summarize the assertions made therein. No admission is made that any such patents, patent applications, publications or references, or any portion thereof, is relevant prior art for the present invention and the right to challenge the accuracy and pertinence of such patents, patent applications, publications, and other references is specifically reserved.

The Invention

In one aspect, the present invention provides devices suitable for removing materials from containers, preparing materials for further use, and storing materials in a container for future use. The devices comprise (1) an elongated portion defining a handle and a blade and (2) an over-cap attached to the elongated portion. In another aspect, the devices comprise an elongated rigid handle, an elongated rigid blade attached to the handle, and a flexible over-cap defining an aperture that surrounds the handle.

In one embodiment, the devices are designed and used to remove some materials from a container while a portion of the materials remain in the container, prepare the removed materials for further use, and store the remaining materials in the container for future use. In a preferred embodiment, the devices are designed and used to remove some food from a container while a portion of the food remains in the container, prepare the removed food for further use (e.g., by mixing the removed food with another food or other materials), and store the remaining food in the container for future use (e.g., by using the over-cap to seal the opened container and protect the food in the container from exposure to environmental conditions). Preferably the food is a dog or cat food that is removed from a container such as a can. Generally, the dog or cat food is a wet food that is mixed with a dry dog or cat foods using a device of the present invention. The over-cap of the device is then used to seal the can and preserve any food remaining in the can for future use.

In addition to the basic device, the devices of the present invention are provided in various configurations and embodiments wherein the devices contain additional and modified features that make the devices more useful and more convenient to use.

In one embodiment, a portion of the handle defines an aperture. In another, the handle comprises a gripping mechanism. In a further embodiment, a portion of the handle defines a concave surface. In another, the handle comprises a tab lifter.

In one embodiment, a center of the over-cap defines an aperture that surrounds the elongated portion. In another, the over-cap is releaseably attached to the elongated portion. In a further embodiment, the over-cap is hermetically attached to the elongated portion.

In one embodiment, a portion of the blade defines a plurality of ribs. In another, a portion of the blade defines a concave surface. In another, the blade has a length that is less than a depth of a typical pet food container. In a further embodiment, the blade incorporates a protrusion at the end of the blade, e.g., a scraping nub. This protrusion can be use to facilitate product removal from the bottom edge or the rim of the container.

In an embodiment, at least one of the handle and the blade comprises a material such as, for example, metal, rigid plastic, thermoplastic elastomers), or combinations thereof.

In an embodiment, the over-cap comprises a flexible material. In another, the over-cap has a sealing bead.

In an embodiment as illustrated in FIG. 1, the present invention provides a device 10 comprising an elongated portion defining a handle 20 and a blade 30. An over-cap 40 is attached to the elongated portion defining the handle 20. The over-cap 40 can be attached to the handle 20 and/or the blade 30. The handle 20 and the blade 30 can comprise any suitable length and thickness.

The device 10 can be made of materials that are dishwasher safe and safe for food contact and removal of food from a container. The handle 20 and/or the blade 30 can comprise any suitable material such as metal, plastic, polymers, or combinations thereof. Preferably, the handle 20 and the blade 30 comprise rigid materials to give the device 10 rigidity for cutting through materials such as, for example, a pet food.

As illustrated in FIG. 1, a portion of the handle 20 can define an aperture 22. For example, the aperture can be used for hanging the device 10 on a hook for convenient storage when the device 10 is not used.

The handle 10 can be ergonomically designed and suited for holding in a user's hands. For example, the handle 20 can comprise a gripping mechanism such as a textured surface or gripping elements to allow the user to firmly grasp the handle 20. As illustrated in FIG. 1, a portion of the handle 20 can define a concave surface 24. The concave surface 24 can act as a thumb or finger rest and a gripping feature of the handle 20.

As illustrated in FIG. 1, the handle 20 can comprise a tab lifter 26. For example, many containers have a lid with an attached tab. Typically, the user removes the lid by using his or her fingers to lift and pull the tab. However, the tab is usually tightly attached to the lid and difficult to lift with the fingers alone. Accordingly, the tab lifter 26 can be used to lift tabs that are attached to the lids of the containers. The tab lifter 26 can be inserted between the tab and the lid to enable the user to more easily lift the tab away from the lid thereby allowing the user to access and pull the tab. Preferably, the tab lifter 26 is molded/integrated into the body of the handle 20. As a result, the tab lifter 26 not only provides a functional feature, but can give the device 10 rigidity for cutting through harder pet food (e.g., refrigerated pet food).

The over-cap 40 can be constructed to fit over the opening of any type of container. In a preferred embodiment, the container comprises any suitable pet food container, e.g. a can. In an embodiment, the container comprises a 13.2 oz. pet food can.

The over-cap 40 can serve a variety of functions. For example, the over-cap 40 can be used as a guard to prevent a user's hands from coming into contact with the material, e.g. food, while using the device 10 to scoop the material out of the container. The over-cap 40 can also be used as a safety mechanism to prevent the user's hands from coming into contact with any sharp edges of the container opening.

Figure 2:
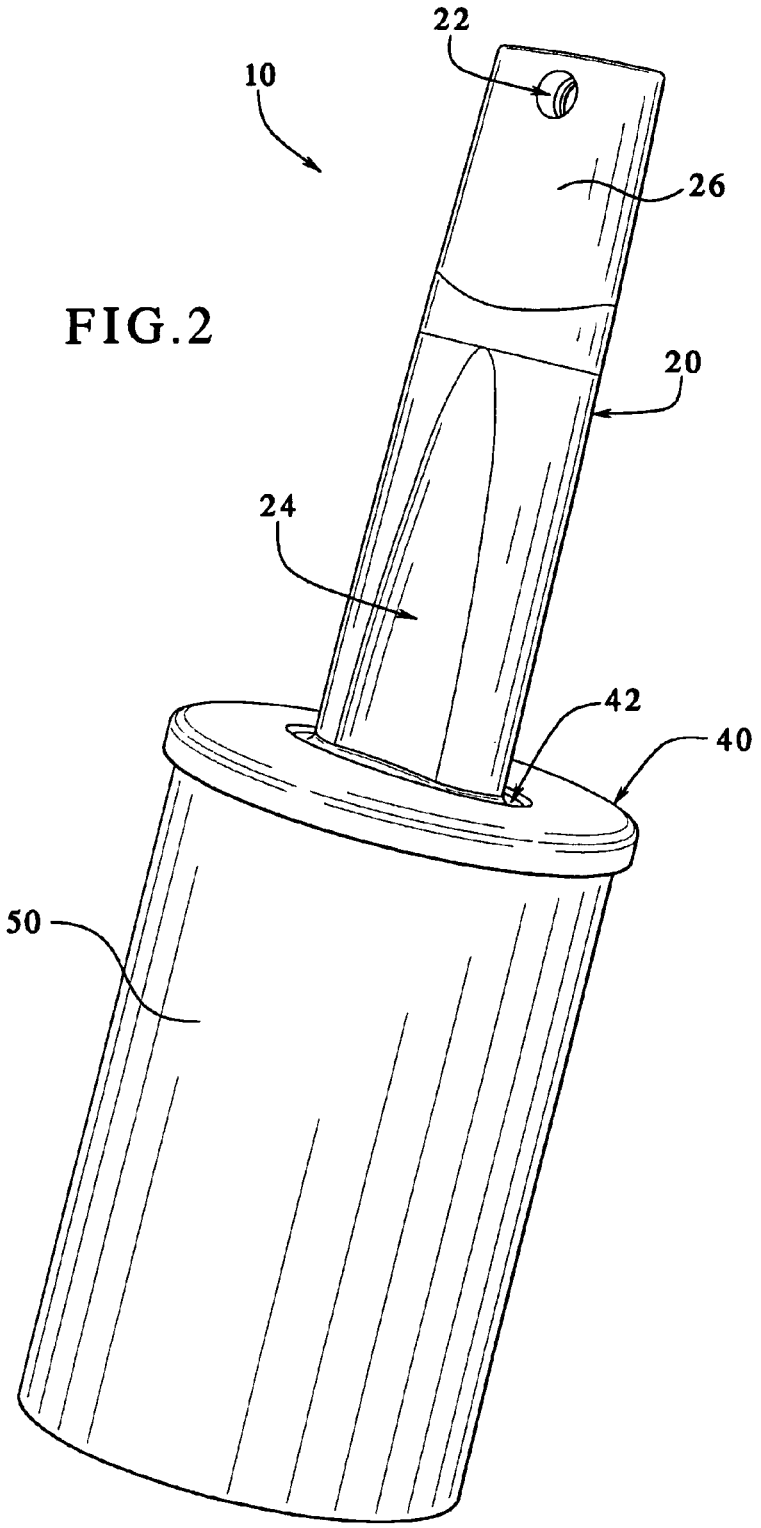
FIG. 2 illustrates a front perspective view of the device covering a container.

As illustrated in FIG. 2, the over-cap 40 can be placed over and seal the opening of a container 50 after the container 50 has been opened. The over-cap 40 can comprise any suitable material such as metal, plastic, polymers or combinations thereof. Preferably, the over-cap 40 comprises a flexible material such as flexible thermoplastic elastomers for conforming to the opening of the container.

In an embodiment as illustrated in FIG. 1, the over-cap 40 defines an aperture 42 that receives and surrounds a portion of the handle 20. For example, the over-cap 40 can comprise molded ribs or flexible material at the aperture 42 that allows the over-cap 40 to flex and conform to the shape of the handle 20. As a result, the over-cap 40 can be releaseably attached to the handle 20 and adjustable for sliding up and down the device 10 (e.g. as illustrated by the directional arrows in FIG. 1). Despite being adjustable, the over-cap 40 can provide a tight, hermetic seal surrounding the handle 20 (and/or blade 30). This prevents air/moisture from traveling through the over-cap 40 at the points where it contacts the handle 20 while the device 10 is being used as a cover for an open container. It should be appreciated that the over-cap 40 can be attached to the blade 30 in the same ways that the over-cap 40 is attached to the handle 20 as discussed above.

The blade 30 can be molded and comprise any suitable features or mechanisms for scooping, serving, preparing, or displacing material such as pet food out of a container. In an embodiment as illustrated in FIG. 1, a portion of the blade 30 can define a plurality of ribs 32. These ribs 32 enable the user to access the inner sides of the can more easily as well as under the inside lip of the can. For example, if the pet food container comprises compression grooves that retain pieces of the pet food when the food is being scooped out, the ribs 32 are designed to enable the user to access the grooves and ridges on the inside of the container to readily remove the material from therein.

As illustrated in FIG. 1, a portion of the blade 30 can define a concave surface 34. For example, the concave surface 34 can be molded into the blade 30. The concave surface 34 of the blade 30 can be used as a spoon or spatula to remove the material from the container and/or prepare the material for further use, e.g., mix a canned animal food with a dry animal food or remove and apply an adhesive to a surface to be bonded. The concave surface 34 can be on either or both sides of the blade 30 so that the device 10 becomes ambidextrous for left and right handed users. As illustrated in FIG. 1, a portion of the blade 30 can define a squared edge 36. For example, the squared edge 36 of the blade 30 can act as a mechanism for cleaning out the hard to reach edges (e.g. top/bottom) of the container. In another embodiment, the blade can define an edge with a nub or protrusion extending from the square edge.

Figure 3:
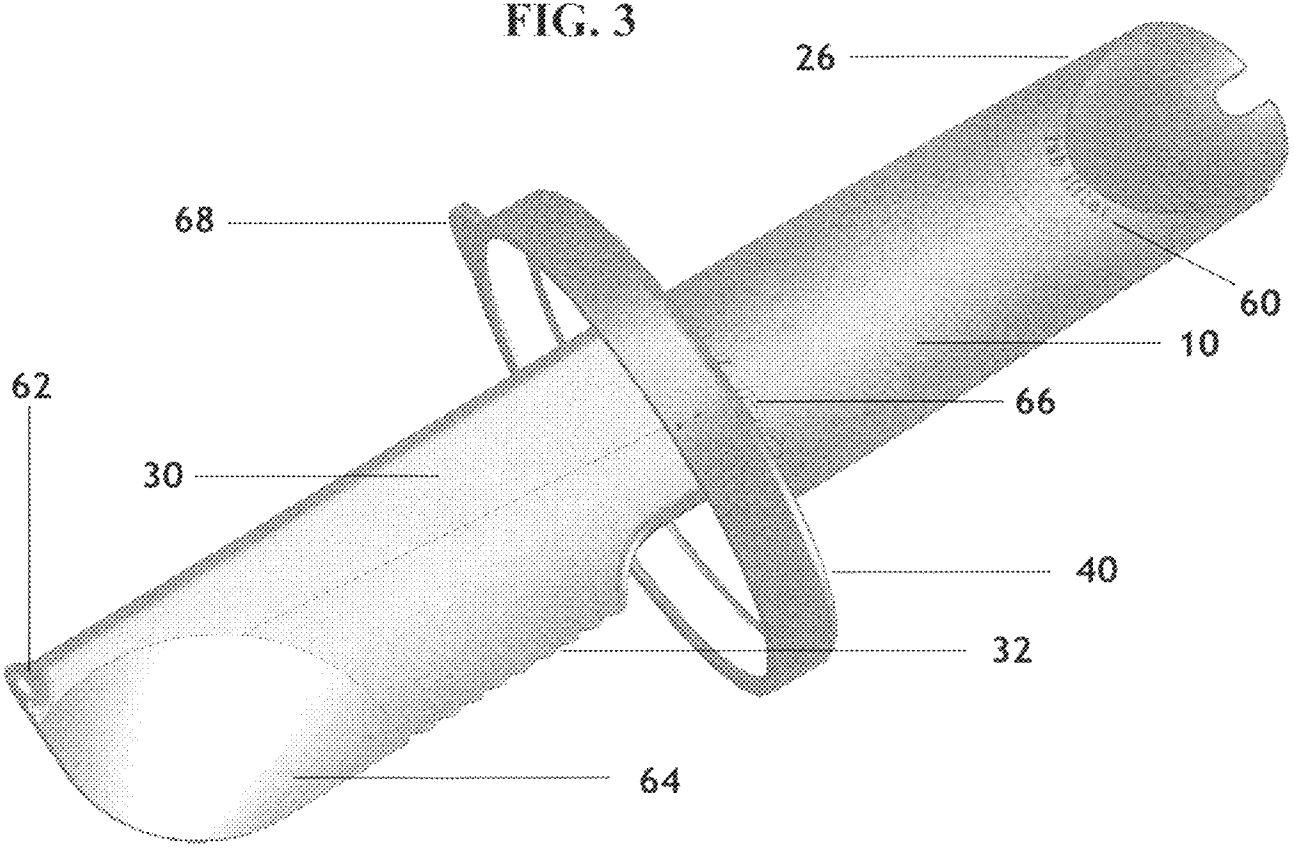
FIG. 3 illustrates a front perspective view of an embodiment of the device of the present invention.

In an embodiment as illustrated in FIG. 3, a alternative tab lifter 26 is shown in one embodiment with a text 60 indicating its function. Also, the blade 30 is shown with a scraping nub 62, a scoop 64, and groves 32. The handle 10 shows text 66 indicating a function, advertisement, product name, company name, and the like. The over-cap 40 also had a tab 68 to facilitate sealing and removal of the over-cap with the container.

In a further aspect, the present invention provides kits suitable for removing materials from a container, preparing materials for further use, and/or storing materials in a container. The kits comprise in separate containers in a single package or in separate containers in a virtual package, as appropriate for the kit component, a device of the present invention and at least one of (1) a container, (2) a container containing a material suitable for being removed, prepared, or stored with the device, (3) instructions for how to use the device to remove all or part of the materials from the container, (4) instructions for how to use the device to prepare the materials from the container for further use, and (5) instructions for how to use the device to store all or part of the materials in the container after the container has been opened. When the kit comprises a virtual package, the kit is limited to instructions in a virtual environment in combination with one or more physical kit components. In one embodiment, the kit comprises the device and the instructions are provided on the internet, by phone, or in a similar virtual package.

In one embodiment, the kit comprises the device of the present invention and a container of food. In a preferred embodiment, the food is food for an animal, preferably a companion animal, most preferably a dog or a cat. The kit may contain the device and a single container of food or may contain the device and multiple containers of food, e.g., a multi-pack.

The kits are useful for removing materials from a container, preparing materials for further use, and storing materials in a container. In one embodiment, a container of wet food is opened, a portion of the food is removed from the container using the device, and the remaining portion of the food is stored in the opened container using the device. Generally, the blade is inserted into the container and the over-cap is used to seal the container from the environment. An optional step involves using the device to mix the wet food with a dry food. In another, the kit comprises the device of the present invention and an empty container, preferably one that can be sealed using the device of the present invention in a manner suitable for storing materials. Materials can be added to the container by the user and removed, prepared, ad/or stored as described herein.

The kit may contain additional items such as a device (e.g., brush) for cleaning the device of the present invention after use or a device for containing the materials after removal from the original container, e.g., a food bowl or a measuring scoop. In one embodiment, a kit contains the device in combination with an empty container that can be used to measure materials.

In another aspect, the present invention provides a means for communicating information about or instructions for one or more of (1) using the devices and kits of the present invention for (1) removing materials from a container, (2) preparing the materials for further use, and (3) storing materials in an opened container. The means comprises a document, digital storage media, optical storage media, audio presentation, or visual display containing the information or instructions. In certain embodiments, the communication means is a displayed web site, visual display kiosk, brochure, isle violator, clip strip, wing display, sales ready display, product label, package insert, advertisement, handout, public announcement, audiotape, videotape, DVD, CD-ROM, computer readable chip, computer readable card, computer readable disk, computer memory, or combination thereof containing such information or instructions. Useful information includes one or more of (1) methods and techniques for removing materials from a container using the devices of the present invention, (2) methods and techniques for storing materials in a container using the devices of the present invention, and (3) contact in formation for users or consumers to use if they have a question about the invention and its use. Useful instructions include cleaning procedures (e.g., dishwasher safe), storage shelf-life, and the like. The communication means is useful for instructing on the benefits of using the present invention and communicating the preferred methods for using the invention for the convenience of the user.

In another aspect, the present invention provides a method for marketing to a user a device suitable for removing a material from a container, preparing the material for further use, or storing unused material in the container for future use. The method comprises providing to the user one or more containers containing materials and the device of the present invention and instructions that show the user how to remove the material from the container using the device and how to store unused material in a container using the device. The container and the device can be provided together in a package or separately. The instructions may also instruct the user on how to use the device to prepare the materials from the container for further use, e.g., how to mix the materials with other materials. In one embodiment, the instructions are provided through a medium selected from the group consisting of web site, brochure, product label, package insert, advertisement, visual display and combinations thereof.

In another aspect, the present invention provides a method for removing a material from a container, preparing the material for further use, and/or storing unused material in the container. The method comprises providing a device of the present invention and a container containing materials. The material is removed from the container by holding the handle and scooping the material with the blade. The unused material is stored in the container by placing the over-cap over the opening of the container. Optionally, the material may be prepared for further use using the device, e.g., by using the blade to mix the material with other materials. In an embodiment, the over-cap is constructed and arranged to provide a hermetic seal over the opening of the container.

In various embodiments, the user removes the material from the container by holding the handle and scooping the material from the container with the blade. The removed material is prepared for any suitable use, e.g., by stirring or mixing the material with other materials. The unused material is stored in the container by placing the over-cap over the opening of the container. For storage, the blade should have a length that is less than the depth of the container. For example, if the device is designed to be used for accessing pet food from a container, the blade would have a length that is less than a length of a typical pet food container. However, it should be noted that the over-cap can be designed to slide up and down the handle/blade so that the length of the blade may not limit the type of containers that the device can seal. Preferably, the over-cap is constructed and arranged to provide a hermetic seal over the opening of the container while it is not being used. Each step can be performed individually with the device or the steps can be performed in any combination.

While the devices and methods of the present invention are particularly useful for canned foods, the devices and methods can be used for any liquid, solid or semi-solid materials that are compatible with the device, e.g., paint; cereal; shortening; cooking oils; paste; adhesives; grease; ice cream; plasters; bonding agents; resurfacing materials such as Bondo; solid & semi-solid food products such as peanut butter, refried beans, pumpkin, frostings, food toppings, and condiments; and the like. In referred embodiments, the devices human food or pet food, particularly dog or cat food.

In the specification, there have been disclosed typical preferred embodiments of the invention and, although specific terms are employed, they are used in a generic and descriptive sense only and not for purposes of limitation, the scope of the invention being set forth in the claims. Obviously many modifications and variations of the invention are possible in light of the above teachings. It is therefore to be understood that within the scope of the appended claims the invention may be practiced otherwise than as specifically described.

What is claimed is:

1. A device comprising (1) an elongated portion defining a handle and a blade, the blade comprising a straight edge side, an opposing edge side having a plurality of ribs, and a squared edge at an end of the straight edge side of the blade and (2) an over-cap attached to the elongated portion.

2. The device of claim 1 wherein a portion of the handle defines an aperture.

3. The device of claim 1 wherein the handle comprises a gripping mechanism.

4. The device of claim 1 wherein a portion of the handle defines a concave surface.

5. The device of claim 1 wherein the handle comprises a tab lifter.

6. The device of claim 1 wherein a portion of the blade defines a concave surface.

7. The device of claim 1 wherein at least one of the handle and the blade comprises a material selected from the group consisting of metal, rigid plastic, thermoplastic elastomers, and combinations thereof.

8. The device of claim 1 wherein the over-cap comprises a flexible material.

9. A device suitable for removing a material from a container, preparing a material for further use, or storing unused material in the container, the device comprising:

an elongated rigid handle, an elongated rigid blade attached to the handle, the elongated rigid blade comprising a straight edge side, an opposing edge side having a plurality of ribs, and a squared edge at an end of the straight edge side of the elongated rigid blade, and a flexible over-cap defining an aperture that surrounds a portion of the handle.

10. The device of claim 1 wherein the blade defines an edge with a nub extending from the square edge.

11. The device of claim 9 wherein the blade defines an edge with a nub extending from the sauare edge.

12. The device of claim 5 wherein the tab lifter is a tapered tab lifter.

* * * * *